US006152589A

United States Patent [19]

Kawaguchi et al.

[11] Patent Number: 6,152,589

[45] Date of Patent: Nov. 28, 2000

[54] LAMP

[75] Inventors: Yoshifumi Kawaguchi; Takashi Futami; Teruo Koike, all of Tokyo, Japan

[73] Assignee: Stanley Electric Co., Ltd., Tokyo, Japan

[21] Appl. No.: 09/320,028

[22] Filed: May 26, 1999

[30] Foreign Application Priority Data

May 28, 1998 [JP] Japan ..... 10-147764

[51] Int. Cl.[7] ..... F21V 7/00; F21W 101/02

[52] U.S. Cl. ..... 362/518; 362/516; 362/522; 362/304; 362/346

[58] Field of Search ..... 362/516, 518, 362/522, 507, 346, 297, 304

[56] References Cited

U.S. PATENT DOCUMENTS

| | | | |
|---|---|---|---|
| 4,498,124 | 2/1985 | Mayer et al. | 362/518 X |
| 4,772,987 | 9/1988 | Kreischmer et al. | 362/346 X |
| 4,914,747 | 4/1990 | Nino | 362/297 X |
| 4,918,580 | 4/1990 | Nino | 362/346 X |
| 5,396,407 | 3/1995 | Taniuchi | 362/518 |
| 5,676,455 | 10/1997 | Johnson et al. | 362/346 X |
| 6,007,223 | 12/1999 | Futami | 362/518 X |

*Primary Examiner*—Laura K. Tso

*Attorney, Agent, or Firm*—Ostrolenk, Faber, Gerb & Soffen, LLP

[57] ABSTRACT

There is provided a lamp comprising a light source, a horizontal double ellipsoidal reflector composed of two reflecting surface units joined horizontally in opposing relation to each other and each formed from a spheroid, and aspheric lenses. Each of the two reflecting surface units is formed by cutting, radially around the center axis of the light source, a portion from the spheroid having a first focal point located on the center axis and adjacent the light source and a second focal point located on a line passing through the first focal point and tilted appropriately from the light-source center axis such that the cut portion spans, around the center axis, a range of 5° to 9° in either vertical direction from a horizontal line. The aspheric lenses are provided horizontally to correspond to the respective second focal points of the reflecting surface units of the ellipsoidal reflector and converge reflected light beams from the respective reflecting surface units. It is also possible to provide a horizontal triple ellipsoidal reflector further comprising a central reflecting surface unit formed from a spheroid and located at the center portion thereof in addition to the two reflecting surface units each formed of a cut portion spanning a range of 5° to 6° around the center axis.

17 Claims, 6 Drawing Sheets

LAMP

BACKGROUND OF THE INVENTION

1. Field of the Invention

The present invention relates to lamps and, more particularly, to a lamp suitable for use as an illumination lamp for a vehicle such as a headlamp or a fog lamp, a signal lamp for a vehicle such as a tail lamp or turn signal lamp, a signal lamp for road traffic, or a signal lamp for railway traffic.

2. Background Art

FIGS. 1 to 3 show conventional lamps of this type. A lamp 90 shown in FIG. 1 basically includes: a light source 91; a revolutional paraboloidal reflector 92; and a lens 93 with a lens cut 93*a*. A light beam from the light source 91 is reflected by the revolutional paraboloidal reflector 92 to form a parallel light beam. The reflected lightbeam is diffused properly by the lens cut 93*a* of the lens 93 to provide a desired light distribution property.

A lamp 80 shown in FIG. 2 includes: a light source 81; a reflector composed of a composite reflecting surface 82; and a lens 83. The composite reflecting surface 82 has a plurality of cylindrical parabolic reflecting surfaces that are arranged to have a parabolic configuration in a vertical cross section taken when the lamp 80 is in a mounted state and have a linear configuration in a horizontal cross section (the state shown in the drawing). The lens 83 has no lens cut so that it is see-through. In the lamp 80, the composite reflecting surface 82 provides the light distribution property by itself.

A lamp 70 shown in FIG. 3 includes: a light source 71; a reflector composed of an ellipsoidal reflecting surface 72 having the light source 71 disposed at a first focal point; an aspheric lens 73; and a shade 74 provided if necessary. The ellipsoidal reflecting surface is composed of a spheroid, a composite ellipsoidal surface, or an ellipsoidal free-form surface. In the arrangement, the aspheric lens 73 project;, under magnification, a light source image formed by converging a light beam at a second focal point to provide an irradiating light beam. The lamp 70 of the type using the ellipsoidal reflecting surface 72 is termed a projector type lamp. The light distribution property is obtained by covering an unwanted portion with the shade 74.

In the lamp 90 shown in FIG. 1, however, the lens cut 93*a* should be formed to have high optical intensity, so that a significant variation is produced in the thickness of the lens 93. This degrades the transparency of the lens and makes it impossible to provide an appearance with enhanced clarity and sense of depth, which is currently preferred on the market.

It is possible to impart an appearance with enhanced clarity to the lamp 80 shown in FIG. 2, since the lens 83 without a lens cut is see-through. However, since the composite reflecting surface 82 positioned at a recessed portion forms a light distribution property, the formation of the light distribution property is limited by such a factor as difficulty in determining the light distribution property in the direction of width.

The lamp 70 shown in FIG. 3 is difficult to mount because of its increased depth dimension. Moreover, the aspheric lens 73 having a small outer diameter leads to a reduced light-emitting area. Therefore, the lamp 70 used as a headlamp is inferior in visibility when viewed from an oncoming vehicle.

Each of the conventional lamps 70, 80, and 90 with the aforesaid structures is generally in wide use. Hence, it is impossible to distinguish them from other items and achieve novelty in terms of design. Furthermore, since the coefficient of use of a luminous flux from the light source is dependent on the depth dimension, the coefficient of use is lowered if the lamp is reduced in thickness.

SUMMARY OF THE INVENTION

It is therefore an object of the present invention to provide a lamp with an unprecedented and novel design including a plurality of aspheric lenses.

Another object of the present invention is to provide a lamp having a light distribution property free from constraints and exhibiting enhanced flexibility particularly in the horizontal direction.

Still another object of the present invention is to provide a lamp having a desired light-emitting area and improved visibility when viewed from an oncoming vehicle.

Yet another object of the present invention is to provide a lamp wherein the coefficient of use of a luminous flux from the light source is unaffected by the depth dimension.

A first aspect of the present invention is to provide a lamp comprising: a light source; a horizontal double ellipsoidal reflector composed of two reflecting surface units joined horizontally in opposing relation to each other, each of the two reflecting surface units being obtained by cutting, radially around a center axis of the light source, a portion from a spheroid having a first focal point located on the center axis and adjacent the light source and a second focal point located on a line passing through the first focal point and tilted appropriately from the center axis such that the cut portion spans, around the center axis, a range of 5° to 90° in either vertical direction from a horizontal line; and aspheric lenses provided to correspond to the respective second focal points of the reflecting surface units of the ellipsoidal reflector and converge reflected light beams from the respective reflecting surface units, each of the aspheric lenses having an optical axis nearly parallel to the center axis.

In the arrangement, the presence of the plurality of aspheric lenses provides an unprecedented and novel design whether the lamp is in the ON state and in the OFF state. As a result, the lamp according to the present invention is distinguished from a lamp in a conventional scheme and receives increased attention, so that the marketability thereof is excellently improved.

Since the reflecting surface units are formed of ellipsoidal reflecting surfaces which are opened outwardly, the reflector, which is a combination thereof, has a reduced depth dimension so that the whole lamp is reduced in thickness and has improved mountability. Moreover, the amount of heat received by each of the aspheric lenses can be reduced by distributing light from the single light source to the plurality of aspheric lenses. As result, it becomes possible to compose the lenses of a resin and achieve an excellent cost reducing effect.

Shades for forming a light distribution pattern may also be disposed at respective near-focal points of the aspheric lenses.

Alternatively, an auxiliary ellipsoidal reflector obtained by cutting a portion from a spheroid having the first focal point and a second focal point located on the center axis may be provided to correspond to the horizontal double ellipsoidal reflector, the auxiliary ellipsoidal reflector being located on the center axis such that a light beam from the light source is minimally intercepted thereby, and an aspheric lens having a center axis nearly parallel to the center axis may be provided to correspond to a second focal point of the auxiliary ellipsoidal reflector.

With the provision of the auxiliary ellipsoidal reflector, the majority of light from the light source can be used as effective irradiating light. This increases the coefficient of use of a luminous flux from the light source and effectively improves the performance of the lamp, thereby providing a brighter lamp. Since the plurality of aspheric lenses have enlarged the light-emitting area, visibility from the viewpoint of the oncoming vehicle is also improved.

A second aspect of the present invention is to provide a lamp comprising: a light source; a horizontal triple ellipsoidal reflector composed of two reflecting surface units joined horizontally in opposing relation to each other and a central reflecting surface unit formed integrally with the two reflecting surface units, each of the two reflecting surface units being obtained by cutting, radially around a center axis of the light source, a portion from a spheroid having a first focal point located on the center axis and adjacent the light source and a second focal point located on a line passing through the first focal point and tilted appropriately from the center axis such that the cut portion spans, around the center axis, a range of 5° to 60° in either vertical direction from a horizontal line, the central reflecting surface unit being obtained from a spheroid having the first focal point and a second focal point located on a valve center axis such that the central reflecting surface unit spans a range centering around the center axis within which the central reflecting surface unit is kept from overlapping the two reflecting surface units on both sides thereof; and aspheric lenses provided to correspond to the respective second focal points of the reflecting surface units of the ellipsoidal reflector and converge reflected light beams from the respective reflecting surface units, each of the aspheric lenses having an optical axis nearly parallel to the center axis.

In the present invention, a shade for forming a light distribution pattern may be provided to correspond to the aspheric lens provided to correspond to the auxiliary ellipsoidal reflector or to correspond to the aspheric lens disposed at a center portion of the horizontal triple ellipsoidal reflector, the shade for forming a light distribution pattern being disposed at a near-focal point of the aspheric lens. This enables the formation of a desired light distribution pattern.

A third aspect of the present invention is to provide a lamp comprising: a light source; a horizontal double free ellipsoidal reflector composed of two reflecting surface units joined horizontally in opposing relation to each other, each of the two reflecting surface units being obtained by cutting, radially around a center axis of the light source, a portion from an elliptic free-form surface having a first focal point located on the center axis and adjacent the light source and a second focal point located on and extending linearly horizontally from a line passing through the first focal point and tilted appropriately from the center axis such that the cut portion spans, around the center axis, a range of 5° to 90° in either vertical direction from a horizontal line; and an aspheric lens provided to correspond to the second focal point of each of the reflecting surface units of the ellipsoidal reflector and converge a reflected light beam from each of the reflecting surface units, the aspheric lens having an optical axis nearly parallel to the center axis.

The arrangement allows the width of irradiation, which is insufficient in a horizontal direction, to be increased.

In the arrangement, a shade for forming a light distribution pattern maybe disposed at a near-focal point of the aspheric lens. Preferably, the shade for forming a light distribution pattern has a configuration corresponding to the position of the second focal point which changes horizontally such that the both end portions of the shade are curved horizontally symmetrically relative to the near-focal point of the aspheric lens toward the aspheric lens.

Alternatively, an auxiliary free ellipsoidal reflector obtained by cutting a portion from a spheroid having the first focal point and a second focal point located on and extending linearly horizontally from the center axis may be provided to correspond to the horizontal double free ellipsoidal reflector, the auxiliary free ellipsoidal reflector being located on the center axis such that a light beam from the light source is minimally intercepted thereby, and an aspheric lens having a center axis nearly parallel to the center axis may be provided to correspond to a second focal point of the auxiliary free ellipsoidal reflector.

A fourth aspect of the present invention is to provide a lamp comprising: a light source; a horizontal triple free ellipsoidal reflector composed of two reflecting surface units joined horizontally in opposing relation to each other and a central reflecting surface unit formed integrally with the two reflecting surface units, each of the two reflecting surface units being obtained by cutting, radially around a center axis of the light source, a portion from an elliptic free-form surface having a first focal point located on the center axis and adjacent the light source and a second focal point located on and extending linearly horizontally from a line passing through the first focal point and tilted appropriately from the center axis such that the cut portion spans, around the center axis, a range of 5° to 60° in either vertical direction from a horizontal line, the central reflecting surface unit being obtained from a spheroid having the first focal point and a second focal point located on and extending linearly horizontally from the center axis such that the central reflecting surface unit spans a range centering around the center axis within which the central reflecting surface unit is kept from overlapping the two reflecting surface units on both sides thereof; and an aspheric lens provided to correspond to the second focal point of each of the reflecting surface units of the ellipsoidal reflector and converge a reflected light beam from each of the reflecting surface units, the aspheric lens having an optical axis nearly parallel to the center axis.

In the arrangement, a shade for forming a light distribution pattern may be provided to correspond to the aspheric lens provided to correspond to the auxiliary free ellipsoidal reflector or to correspond to the aspheric lens disposed at a center portion of the horizontal triple free ellipsoidal reflector, the shade for forming a light distribution pattern being disposed at a near-focal point of the aspheric lens. Preferably, the shade has a configuration corresponding to the position of the second focal point which changes horizontally such that the both end portions of the shade are curved horizontally symmetrically relative to the near-focal point of the aspheric lens toward the aspheric lens.

Preferably, all the aspheric lenses are formed integrally with a lens holder portion and the lens holder portion is formed transparent or opaque.

By providing the lens holder portion and forming all the aspheric lenses integrally therewith, if the lens holder portion is transparent, it becomes possible to mix an image from the lens holder portion through which the inner surface of the lamp is viewed as it is with an image from the aspheric lenses through which the inner surface of the lamp is viewed under magnification, thereby providing an unprecedented and novel appearance.

Alternatively, each of the aspheric lenses is preferably composed of any one selected from a convex lens, a Fresnel lens, and a combination thereof.

If the aspheric lens is formed in a Fresnel configuration, an appearance like crystal glass can be obtained. Thus, the present invention offers wider design variations to a lamp and achieves an excellent effect in improving the marketability of the lamp.

At this time, each of the aspheric lenses may have a configuration partly combined with a cylindrical lens.

At least one of the surface of the shade for forming a light distribution pattern viewed through the aspheric lens and the lens holder portion may be in a color other than the color of the aspheric lens.

If the lens holder portion is formed opaque and/or colored and the shade is also colored, it becomes possible to implement a lamp presenting different colors in the ON state and in the OFF state, respectively.

Alternatively, the light source may be provided with a filter in the form of a cap composed of a diffusion filter or a color filter.

DETAILED DESCRIPTION OF THE PREFERRED EMBODIMENTS

Figure 4:
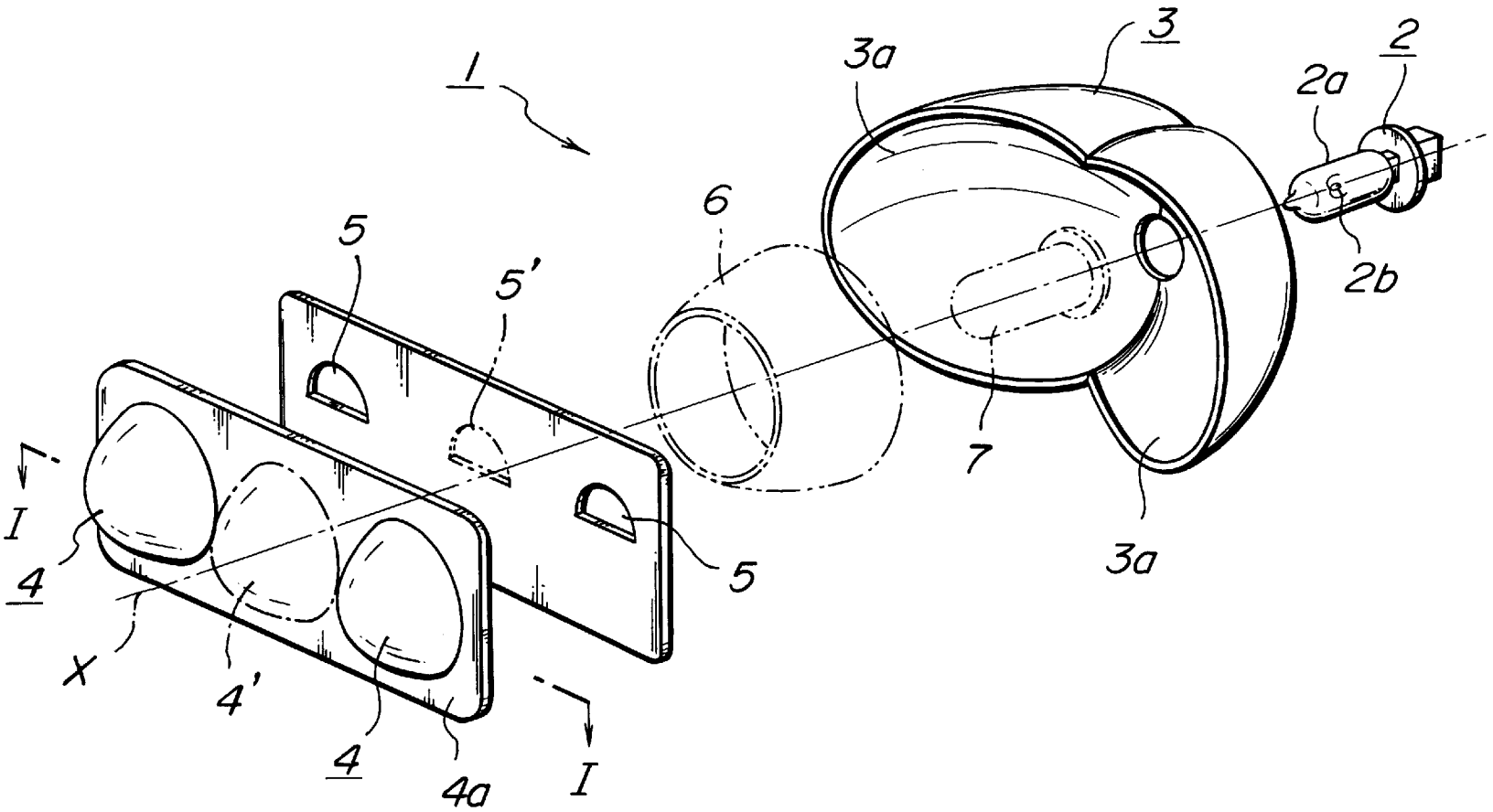
FIG. 4 is a perspective view showing a lamp according to a first embodiment of the present invention, which is partly in an exploded state.
Figure 5:
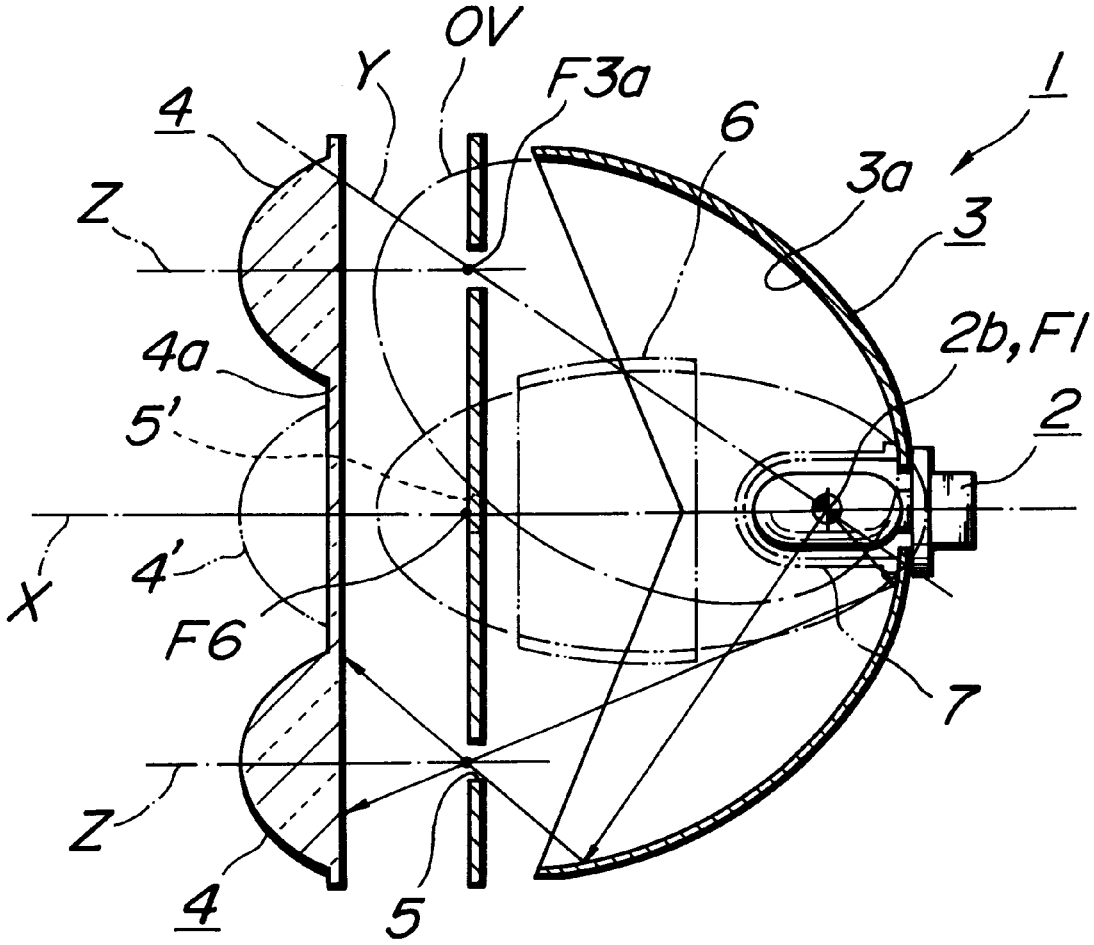
FIG. 5 is a cross-sectional view taken along the line I—I of FIG. 4.

The present invention will now be described in detail with reference to the drawings which illustrate the embodiments thereof. FIGS. 4 and 5 show a lamp 1 according to the first embodiment of the present invention. The lamp 1 is basically composed of: a single light source 2; a horizontal double ellipsoidal reflector 3 (hereinafter simply referred to as an ellipsoidal reflector) consisting of a range of two reflecting surfaces 3*a* joined horizontally to each other; and two aspheric lenses 4.

By way of example, a description will be given to the case where the lamp 1 according to the present embodiment is used as, e.g., a headlamp for a vehicle. The description is therefore based on the assumption that, if necessary, a shade 5 for forming a light distribution pattern is provided to correspond to the lamp and an auxiliary ellipsoidal reflector 6 for an increased quantity of light or improved design is also provided in combination with an aspheric lens 4' and a shade 5' for forming a light distribution pattern, which are optionally provided to correspond to the auxiliary ellipsoidal reflector 6.

Preferably, an incandescence lamp, a halogen lamp, a metal halide lamp, or the like is used as the Light source 2. Although the present embodiment has adopted, as the light source 2, a light source with a single filament having a single light-emitting source 2*b* in a bulb 2*a*, a light source with a double filament may also be adopted as required.

As shown in FIG. 5, each of the reflecting surface units 3*a* is defined relative to a center axis X which passes through the center of the valve 2*a* and extends in the direction of irradiation from the lamp 1. The light-emitting source 2*b* is present on the center axis X.

A description will be given to a method of forming the reflecting surface unit 3*a* in accordance with the present invention. First, a line passing through the light-emitting source 2*b* and tilted horizontally from the center axis X by 10° to 80° is defined to obtain the long axis of an ellipse used as a reference. On the other hand, a first focal point F1 is assumed to be located at the light-emitting source 2*b*.

Next, a second focal point F3*a* is located appropriately on the long axis Y and an ellipse OV having two focal points at the first and second focal points F1 and F3*a* is assumed. The ellipse OV is rotated around the long axis Y to define a spheroid used as the reference for the reflecting surface unit 3*a*.

The inner surface of the spheroid forms the reflecting surface unit 3*a* to be obtained. Accordingly, a portion of the spheroid which is effective as a reflecting surface, i.e., the portion covering a range that can reflect a light beam from the light-emitting source 2*b* in the direction of irradiation from the lamp 1 is cut from the spheroid. Each of the reflecting units 3*a* is obtained by further cutting, radially around the center axis X, a portion from the cut portion such that the resulting cut portion spans, around the center axis X, a range of 5° to 90° in either vertical direction from a horizontal line.

The reflecting units 31 obtained are joined bilaterally to each other to provide the ellipsoidal reflector 3. The present embodiment shows an example in which the ellipsoidal reflector 3 consists of the two reflecting surface units 3*a* jointed to each other, each of which is obtained by radially cutting, around the center axis X, a portion from the spheroid such that the cut portion spans, around the center axis X, a range of 90° in either vertical direction from a horizontal line, i.e., by cutting the spheroid along a line passing through the center axis.

The aspheric lenses 4 each having its optical axis Z nearly parallel to the center axis X are disposed adjacent the respective second focal points F3*a* of the ellipsoidal reflector 3 thus formed. The aspheric lenses 4 project the images of the light-emitting source 2*b* formed at the second focal points F3*a* in the direction of irradiation from the lamp 1.

If the lamp 1 is used as, e.g., an automobile headlamp for a low beam and required of a specified light distribution pattern, the shades 5 for forming the light distribution pattern are provided adjacent the respective focal points F3*a*. The shades 5 for forming the light distribution pattern provide an objective light distribution pattern by intercepting those portions of the light beams reflected from the reflecting surface units 3*a* which are projected in the direction of irradiation by the aspheric lenses 4 to form upward light radiation.

If the brightness of the lamp 1 is to be increased or the design thereof is to be varied, the auxiliary ellipsoidal reflector 6 formed from a spheroid having a long axis coincident with the center axis X is provided separately, as indicated by the dot-dash lines in FIGS. 4 and 5. The auxiliary ellipsoidal reflector 6 has a first focal point F1 located at the light-emitting source 2*b* and a second focal point F6 located on the center axis X, similarly to the reflecting surface units 3*a*.

In the case where the auxiliary ellipsoidal reflector 6 is provided, it is designed to have such a configuration that the light beam from the light-emitting source 2*b* before reaching the reflecting surface units 3*a* is minimally intercepted thereby. The aspheric lens 4' is provided adjacent the second focal point F6 of the auxiliary ellipsoidal reflector 6 thus disposed. If necessary, a shade 5' for forming a light distribution pattern may also be provided.

A description will be given to the respective positions at which the aspheric lenses 4 and 4' are disposed. Since the two aspheric lenses 4 are provided for the bilateral reflecting surface units 3*a*, they are disposed at bilateral positions unless the reflecting surface units 3*a* are particularly designed to have different focal lengths or the like.

The aspheric lens 4' is disposed at a position adjacent the second focal point F6 of the auxiliary ellipsoidal reflector 6. By optimizing the focal length of the aspheric lens 4', therefore, it becomes possible to dispose the aspheric lens 4' at a position close to the two aspheric lenses 4 on substantially the same plane. If a lens holder portion 4*a* for providing a connection between the aspheric lenses 4 and 4', the aspheric lenses 4 and 4' can be formed integrally.

In integrally forming the aspheric lenses 4 and 4', the aspheric lenses 4 and 4' are naturally formed of a transparent material. The lens holder portion 4*a* may be formed of the same material. Alternatively, the lens holder portion 4*a* maybe formed in a different color, either transparent or opaque, by using a two-color molding technique or the like, since the lens holder portion 4*a* is irrelevant to the irradiation of light. Coloring may also performed through painting or the like after the formation of the lens holder portion 4*a*.

In the case where the aspheric lenses 4 and 4' are formed integrally with the lens holder portion 4*a*, if the color imparted to the frame of the vehicle is also imparted to the lens holder portion 4*a* and to those sides of the similarly integrated shades 5 and 5' facing the aspheric lenses 4, the color of the lens holder portion 4*a* is recognized during the daytime, while the color imparted to the shades 5 and 5' for forming a distribution pattern can be viewed through the aspheric lenses 4 and 4'. This enables the entire lamp 1 to be viewed from every direction in the same color as the car frame, thus widening the range of applications and increasing design flexibility.

In FIG. 5, a reference numeral 7 denotes a filter. The filter 7 is configured as a cap covering the light source 2 to diffuse or color the light beam emitted from the light-emitting source 2*b* and reaching the ellipsoidal reflector 3 as well as the auxiliary ellipsoidal reflector 6. In a typical lamp composed of an ellipsoidal reflecting surface and an aspheric lens, irradiating light is generally formed into spot light. Accordingly, a brightness difference between an illuminated place and an unilluminated place tends to be significant. In this case, if a filter having a frosted surface or the like and proper diffusiveness is used as the filter 7, the light beam from the light source 2 is properly diffused on passing through the filter 7, so that the significant brightness difference is alleviated. It is also possible to impart an appropriate color such as amber to the filter 7, instead of imparting diffusiveness thereto, so that the lamp 1 is suitable for use as a fog lamp or the like. Alternatively, the lamp 1 can also be used as a traffic signal if it is colored red, blue, yellow, or the like.

Figure 6:
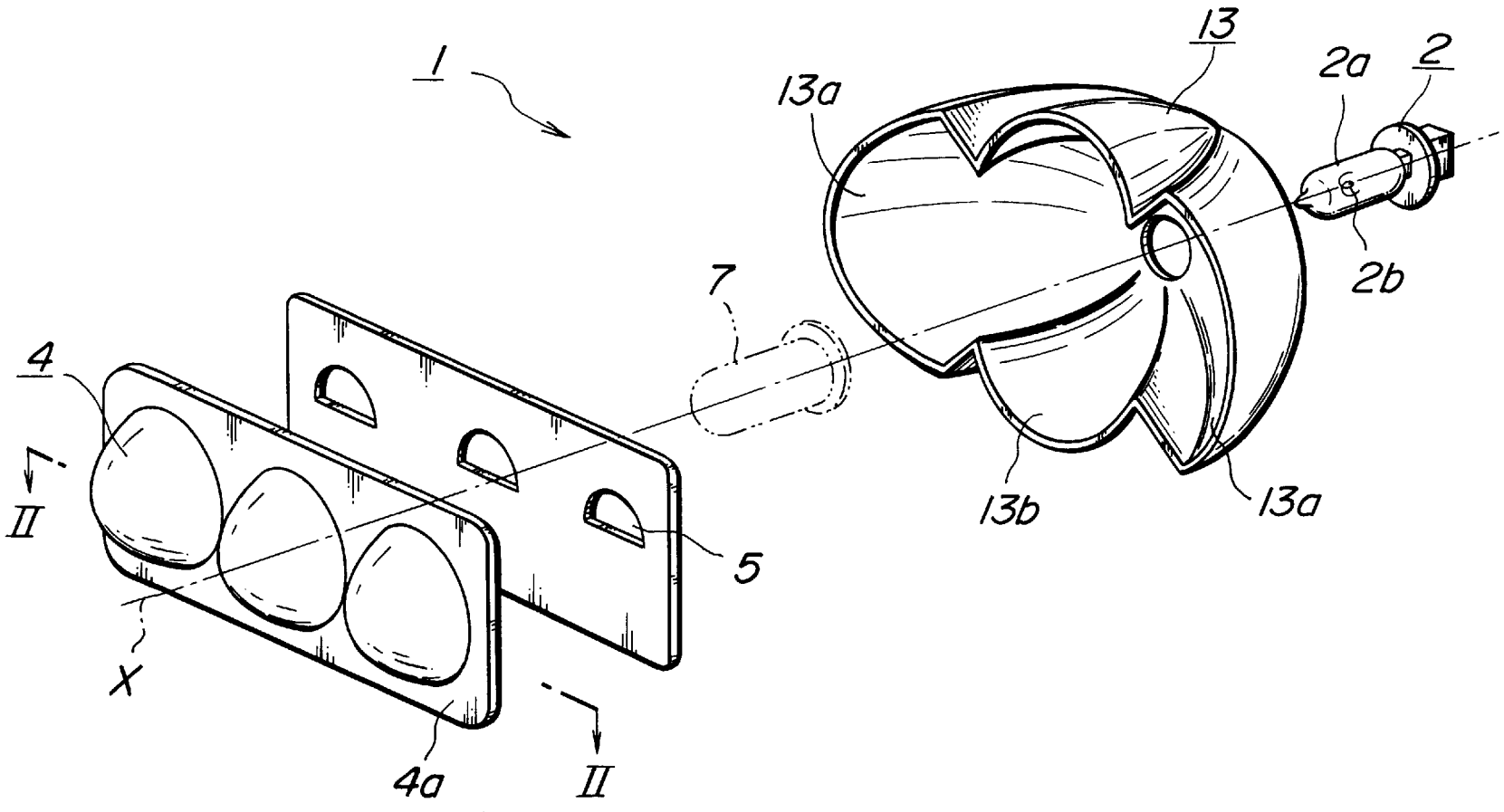
FIG. 6 is a perspective view showing a lamp according to a second embodiment of the present invention, which is partly in an exploded state.
Figure 7:
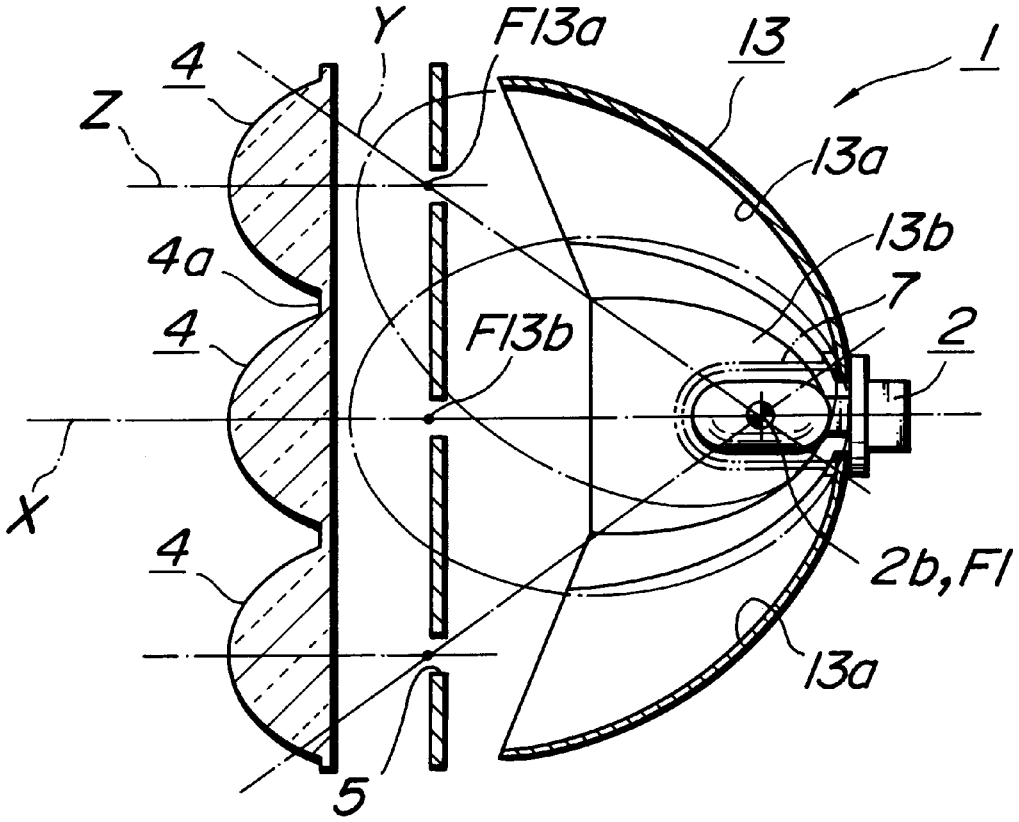
FIG. 7 is a cross-sectional view taken along the line II—II of FIG. 6.

FIGS. 6 and 7 show the second embodiment of the present invention. The second embodiment is the same as the first embodiment in that two reflecting units 13*a* each having a second focal point F13*a* on a tilted long axis Y are joined to each other. In contrast to the first embodiment in which each of the reflecting surface units 3*a* is obtained by cutting, radially around the center axis X, a portion from the spheroid such that the cut portion spans, around the center axis X, a range of 5° to 90° in either vertical direction from a horizontal line, the second embodiment obtains the reflecting surface unit 13*a* by cutting, around the center axis X, a portion from a spheroid such that the cut portion spans, around the center axis X, a range of 5° to 60° in either vertical direction from a horizontal line.

If the cut portion spans, around the center axis, a range of 45° in either vertical direction from the horizontal line, the two reflecting surface units 13*a* joined to each other have a generally ∞-shaped configuration. What results is a radial space in which a reflecting surface spanning, around the center axis X, a range of 90° in either vertical direction is not present.

In the second embodiment, a central reflecting surface unit 13*b* having a long axis coincident with the center axis X is formed in the foregoing space in which the central reflecting surface unit 13*b* is kept from overlapping the two reflecting surface units 13*a*. By integrally forming the central reflecting surface unit 13*b* with each of the reflecting surface units 13*a*, there is formed an ellipsoidal reflector 13 having three ellipsoidal reflecting surfaces joined horizontally. It is to be noted that the central reflecting surface unit 13*b* has a first focal point F1 located at the light-emitting source 2*b* and a second focal point F13*b* located on the valve center axis X.

Aspheric lenses 4 are disposed adjacent the respective second focal points F13*a* and F13*b* of the reflecting surface units 13*a* and 13*b* of the ellipsoidal reflector 13 thus formed. Similarly to the first embodiment, a lens holder portion 4*a* is provided such that the three lenses are formed integrally, shades 5 for forming a light distribution pattern are provided, or a filter 7 is provided.

Figure 8:
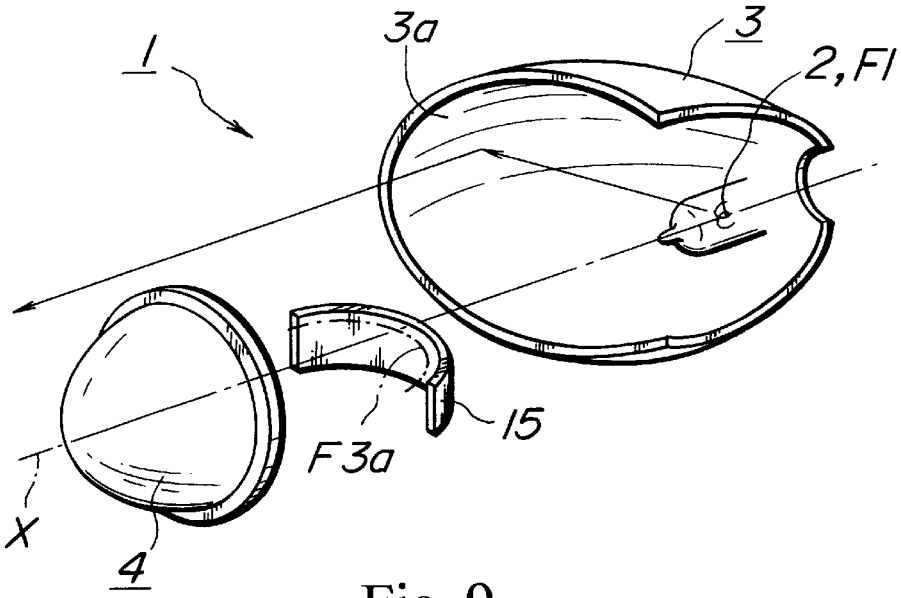
FIG. 8 is a cross-sectional view showing a principal portion of a lamp according to the third embodiment.

FIG. 8 shows a principal portion of the third embodiment of the present invention. In the first and second embodiments, each of the reflecting surface units 3*a* and central reflecting surface unit 13*b* composing the reflectors 3 and 13 and the auxiliary ellipsoidal reflector 6 is formed by using a spheroid. If the lamp 1 is used as a headlamp, it has been indicated that the irradiation from a reflector formed by using a spheroid has only an insufficient width in a horizontal direction.

Figure 1:
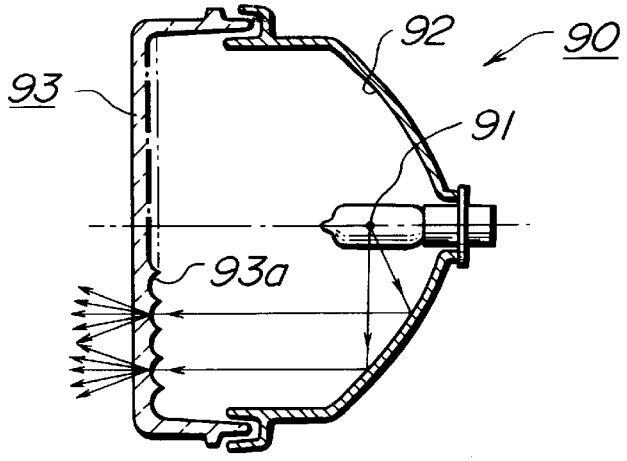
Fig. 1 Prior Art
FIG. 1 is a cross-sectional view showing a conventional embodiment.
Figure 2:
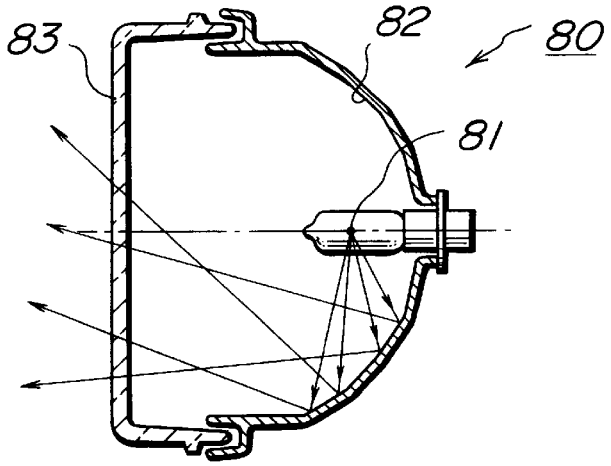
Fig. 2 Prior Art
FIG. 2 is a cross-sectional view showing another conventional embodiment.
Figure 3:
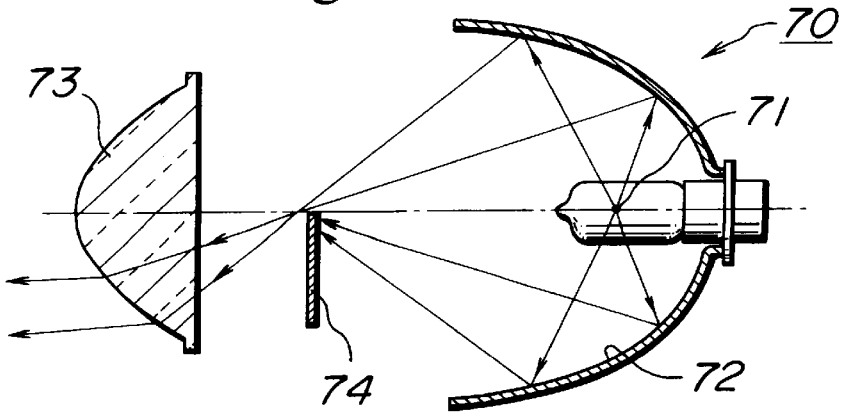
Fig.3 Prior Art
FIG. 3 is a cross-sectional view showing still another conventional embodiment.

The third embodiment has been achieved in view of the foregoing. To correspond to the first embodiment, each of the reflecting surface units 3*a* is formed of an elliptic free-form surface (composite elliptic surface) such that the second focal points F3*a* and F6 linearly expand in a horizontal direction and the auxiliary ellipsoidal reflector 6 is also formed of an elliptic free-form surface having a similar second focal point. To correspond to the second embodiment, each of the reflecting surface units 13*a* is formed of an elliptic free-form surface (composite elliptic surface) such that the second focal points F13*a* and F13*b* linearly expand in a horizontal direction and the central reflecting surface unit 13*b* is also formed of an elliptic free-form surface having a similar second focal point. The drawing shows the case where the third embodiment is implemented to correspond to the first embodiment. Since means for forming a reflector from an elliptical free-form surface has widely been used in the conventional projector type lamp (see FIG. 3), the detailed description thereof is omitted here.

The reflecting surface units 3*a* or 13*a* and the auxiliary ellipsoidal reflector 6 or the central reflecting surface unit 13*b* each formed of an ellipsoidal free-form surface having a second focal point linearly expanding in a horizontal direction are combined to form the reflector having the same configuration as shown in the first or second embodiment. In the lamp 1 of the third embodiment thus structured, a basic light distribution property has a generally elliptic configuration with a long axis extending in a horizontal direction, which compensates for the insufficient width of illumination in the horizontal direction.

If the lamp 1 according to the third embodiment is used for a low beam, a shade 15 for forming a light distribution pattern is provided between each of the reflecting surface units 3*a*, 13*a*, 13*b*, and 6 and the aspheric lens 4 or 4' to correspond to each of the reflecting surface units 3*a*, 13*a*, 13*b*, and 6. In this case, the shade 15 for forming a light distribution pattern is composed of a shade configured to have both end portions curved horizontally symmetrically relative to the near focal point of the aspheric lens 4 or 4' toward the aspheric lens 4 or 4', thereby corresponding to the second focal point of each of the reflecting surfaces which is linear in a horizontal direction. Since means for curving the shade 15 for forming a light distribution pattern is also used in the conventional projector type lamp (see FIG. 3), the detailed description thereof is omitted here.

Figure 9:
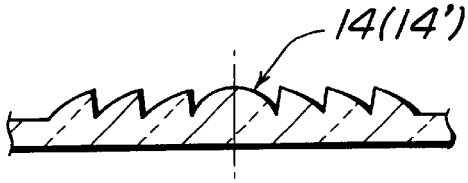
FIG. 9 is a cross-sectional view showing a principal portion of a lamp according to a fourth embodiment of the present invention.
Figure 10:
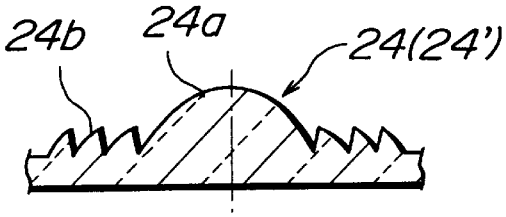
FIG. 10 is a cross-sectional view showing a principal portion of a lamp according to a fifth embodiment of the present invention.

FIGS. 9 and 10 show respective principal portions of the fourth and fifth embodiments of the present invention. Although the aspheric lens 4 (or 4') has been formed as a convex lens in any of the first, second, and third embodiments described above, the present invention is not limited thereto. It is also possible to form the aspheric lens in a Fresnel configuration to provide an aspheric Fresnel lens 14 (14'), as shown in FIG. 9 illustrating the fourth embodiment. Alternatively, it is also possible to form a deformed aspheric lens 24 (24'), which is composed of a center portion 24*a* in the form of a convex lens and a peripheral portion 24*b* in the form of a Fresnel lens, as shown in FIG. 10 illustrating the fifth embodiment. This allows the aspheric lens 4 (4') normally having a configuration projecting conspicuously toward the viewer side to have a less conspicuous forward projection, resulting in a design variation. If the pitch for forming the lens in a Fresnel configuration is controlled properly, an appearance like crystal glass can be imparted to the lens. By forming the lens in a Fresnel configuration, the thickness of the lens becomes uniform. In the case of forming the aspheric lens portion from a resin, therefore, such deformation as sink does not occur during molding, so that optical accuracy is increased.

Figure 11:
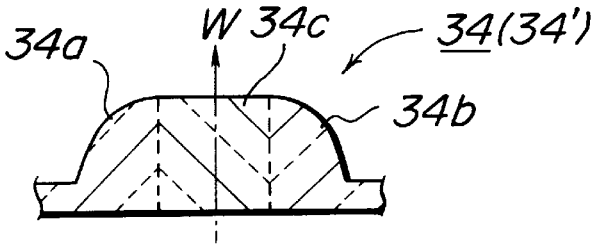
FIG. 11 is a cross-sectional view showing a principal portion of a lamp according to a sixth embodiment of the present invention.

FIG. 11 shows a principal portion of the sixth embodiment of the present invention. An aspheric lens 34 (34') in the sixth embodiment is composed of lens portions 34*a* and 34*b* and a cylindrical portion 34*c*. The lens portions 34*a* and 34*b* are configured as the halves of the aspheric lens 4 illustrated in the first embodiment, which are obtained by halving the aspheric lens 4 with the center axis. On the other hand, the cylindrical portion 34*c* is configured as a so-called cylindrical lens.

The lens portions 34*a* and 34*b* have their respective divided surfaces connected to the both ends of the cylindrical portion 34*c*. By thus forming the aspheric lens 34, even a luminous flux having a nearly circular cross section from the reflecting surface unit 3*a* formed from the spheroid, as shown in the first embodiment, is enlarged in the direction of the axis W of the cylindrical portion 34*c* on passing through the spherical lens 34. In the case of using the lamp 1 as a headlamp or the like, therefore, the light distribution property which is wide in the horizontal direction can be obtained by disposing the lamp 1 such that the axis W extends in the horizontal direction.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A lamp comprising:

a light source;

a horizontal double ellipsoidal reflector composed of two reflecting surface units joined horizontally in opposing relation to each other, each of the two reflecting surface units being obtained by cutting, radially around a center axis of said light source, a portion from a spheroid having a first focal point located on said center axis and adjacent the said light source and a second focal point located on a line passing through said first focal point and tilted appropriately from said center axis such that the cut portion spans, around the center axis, a range of 5° to 9° in either vertical direction from a horizontal line; and aspheric lenses provided to correspond to said respective second focal points of the reflecting surface units of said ellipsoidal reflector and converge reflected light beams from the respective reflecting surface units, each of the aspheric lenses having an optical axis nearly parallel to said center axis.

2. The lamp according to claim 1, wherein shades for forming a light distribution pattern are disposed at respective near-focal points of said aspheric lenses.

3. The lamp according to claim 1, wherein an auxiliary ellipsoidal reflector obtained by cutting a portion from a spheroid having said first focal point and a second focal point located on the center axis is provided to correspond to said horizontal double ellipsoidal reflector, the auxiliary ellipsoidal reflector being located on said center axis such that a light beam from the light source is minimally intercepted thereby, and an aspheric lens having a center axis nearly parallel to said center axis is provided to correspond to a second focal point of the auxiliary ellipsoidal reflector.

4. The lamp according to claim 3, wherein a shade for forming a light distribution pattern is provided to correspond to the aspheric lens provided to correspond to said auxiliary ellipsoidal reflector, the shade for forming a light distribution pattern being disposed at a near-focal point of the aspheric lens.

5. The lamp according to claim 1, wherein all the aspheric lenses are formed integrally with a lens holder portion and said lens holder portion is any of a transparent member, a colored transparent member, and a colored opaque member.

6. The lamp according to claim 1, wherein each of said aspheric lenses is composed of any one selected from a convex lens, a Fresnel lens, and a combination thereof.

7. The lamp according to claim 1, wherein each of said aspheric lenses has a configuration partly combined with a cylindrical lens.

8. The lamp according to claim 1, wherein at least one of the surface of said shade for forming a light distribution pattern viewed through said aspheric lens and said lens holder portion is in a color other than the color of the aspheric lens.

9. The lamp according to claim 1, wherein the light source is provided with a filter in the form of a cap composed of a diffusion filter or a color filter.

10. A lamp comprising:

a light source;

a horizontal triple ellipsoidal reflector composed of two reflecting surface units joined horizontally in opposing relation to each other and a central reflecting surface unit formed integrally with the two reflecting surface units, each of the two reflecting surface units being obtained by cutting, radially around a center axis of said light source, a portion from a spheroid having a first focal point located on said center axis and adjacent the light source and a second focal point located on a line passing through said first focal point and tilted appropriately from said center axis such that the cut portion spans, around the center axis, a range of 5° to 60° in either vertical direction from a horizontal line, the central reflecting surface unit being obtained from a spheroid having said first focal point and a second focal point located on a valve center axis such that the central reflecting surface unit spans a range centering around the center axis within which the central reflecting surface unit is kept from overlapping the two reflecting surface units on both sides thereof; and aspheric lenses provided to correspond to said respective second focal points of the reflecting surface units of said ellipsoidal reflector and converge reflected light beams from the respective reflecting surface units, each of the aspheric lenses having an optical axis nearly parallel to said center axis.

11. The lamp according to claim 10, wherein a shade for forming a light distribution pattern is provided to correspond to the aspheric lens disposed at a center portion of said horizontal triple ellipsoidal reflector, the shade for forming a light distribution pattern being disposed at a near-focal point of the aspheric lens.

12. A lamp comprising:

a light source;

a horizontal double free ellipsoidal reflector composed of two reflecting surface units joined horizontally in opposing relation to each other, each of the two reflecting surface units being obtained by cutting, radially around a center axis of said light source, a portion from an elliptic free-form surface having first focal point located on said center axis and adjacent the light source and a second focal point located on and extending in early horizontally from a line passing through said first focal point and tilted appropriately from said center axis such that the cut portion spans, around the center axis, a range of 5° to 90° in either vertical direction from a horizontal line; and an aspheric lens provided to correspond to said second focal point of each of the reflecting surface units of said ellipsoidal reflector and converge a reflected light beam from each of the reflecting surface units, the aspheric lens having an optical axis nearly parallel to said center axis.

13. The lamp according to claim 12, wherein a shade for forming a light distribution pattern is disposed at a near-focal point of said aspheric lens, the shade for forming a light distribution pattern having a configuration corresponding to the position of the second focal point which changes horizontally such that the both end portions of the shade are curved horizontally symmetrically relative to the near-focal point of the aspheric lens toward the aspheric lens.

14. The lamp according to claim 13, wherein an auxiliary free ellipsoidal reflector obtained by cutting a portion from a spheroid having said first focal point and a second focal point located on and extending linearly horizontally from the center axis is provided to correspond to said horizontal double free ellipsoidal reflector, the auxiliary free ellipsoidal reflector being located on said center axis such that a light beam from the light source is minimally intercepted thereby, and an aspheric lens having a center axis nearly parallel to said center axis is provided to correspond to a second focal point of the auxiliary free ellipsoidal reflector.

15. The lamp according to claim 14, wherein a shade for forming a light distribution pattern is provided to correspond to the aspheric lens provided to correspond to said auxiliary free ellipsoidal reflector, the shade for forming a light distribution pattern being disposed at a near-focal point of the aspheric lens and having both end portions curved horizontally symmetrically relative to the near-focal point of the aspheric lens toward the aspheric lens to correspond to the position of the second focal point which changes horizontally.

16. A lamp comprising:

a light source;

a horizontal triple free ellipsoidal reflector composed of two reflecting surface units joined horizontally in opposing relation to each other and a central reflecting surface unit formed integrally with the two reflecting surface units, each of the two reflecting surface units being obtained by cutting, radially around a center axis of said light source, a portion from an elliptic free-form surface having a first focal point located on said center axis and adjacent the light source and a second focal point located on and extending linearly horizontally from a line passing through said first focal point and tilted appropriately from said center axis such that the cut portion spans, around the center axis, a range of 5° to 60° in either vertical direction from a horizontal line, the central reflecting surface unit being obtained from a spheroid having said first focal point and a second focal point located on and extending linearly horizontally from the center axis such that the central reflecting surface unit spans a range centering around the center axis within which the central reflecting surface unit is kept from overlapping the two reflecting surface units on both sides thereof; and an aspheric lens provided to correspond to said second focal point of each of the reflecting surface units of said ellipsoidal reflector and converge a reflected light beam from each of the reflecting surface units, the aspheric lens having an optical axis nearly parallel to said center axis.

17. The lamp according to claim 16, wherein a shade for forming a light distribution pattern is provided to correspond to the aspheric lens disposed at a center portion of said horizontal triple free ellipsoidal reflector, the shade for forming a light distribution pattern being disposed at a near-focal point of the aspheric lens and having both end portions curved horizontally symmetrically relative to the near-focal point of the aspheric lens toward the aspheric lens to correspond to the position of the second focal point which changes horizontally.

* * * * *